US006894017B2

(12) United States Patent
Brouwn et al.

(10) Patent No.: US 6,894,017 B2
(45) Date of Patent: May 17, 2005

(54) LIQUID DETERGENT COMPOSITIONS

(75) Inventors: Lili Faucia Brouwn, Vlaardingen (NL); John Hines, Bebington (GB); Johannes Cornelis Van De Pas, Vlaardingen (NL)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 106 days.

(21) Appl. No.: 10/284,232

(22) Filed: Oct. 30, 2002

(65) Prior Publication Data

US 2003/0109408 A1 Jun. 12, 2003

(30) Foreign Application Priority Data

Nov. 1, 2001 (GB) ..... 0126280

(51) Int. Cl.[7] ..... C11D 17/00

(52) U.S. Cl. ..... 510/425; 510/499; 510/481; 510/276

(58) Field of Search ..... 510/425, 499, 510/481, 276, 280, 343, 353, 389, 421, 403

(56) References Cited

U.S. PATENT DOCUMENTS

| | | | | |
|---|---|---|---|---|
| 3,869,399 | A | 3/1975 | Collins | 252/118 |
| 4,820,308 | A | 4/1989 | Madrange et al. | 8/405 |
| 6,093,776 | A | 7/2000 | Shih et al. | 525/359.3 |
| 6,255,264 | B1 | 7/2001 | Fleurot et al. | 510/124 |
| 6,271,386 | B1 | 8/2001 | Shih et al. | 546/347 |
| 6,362,156 | B1 * | 3/2002 | Hsu et al. | 510/418 |
| 6,506,716 | B1 * | 1/2003 | Delplancke et al. | 510/336 |

FOREIGN PATENT DOCUMENTS

| | | |
|---|---|---|
| WO | 94/00543 | 1/1994 |
| WO | 96/17591 | 6/1996 |
| WO | 97/23591 | 7/1997 |
| WO | 97/23592 | 7/1997 |
| WO | 98/23723 | 6/1998 |
| WO | 01/53600 | 7/2001 |

OTHER PUBLICATIONS

PCT International Search Report in a PCT application PCT/EP 02/11265.

Derwent Abstract of WO 94/00543 published Jan. 6, 1994.

Derwent Abstract of WO 98/23723 published Jun. 4, 1998.

* cited by examiner

*Primary Examiner*—Necholus Ogden
(74) *Attorney, Agent, or Firm*—Rimma Mitelman

(57) ABSTRACT

An isotropic aqueous liquid detergent composition comprising:

(a) from 0% to 6%, preferably from 1% to 4% by weight of synthetic anionic surfactant;

(b) from 5% to 25%, preferably from 10% to 20% by weight of soap;

(c) from 0.03% to 5%, preferably from 0.10% to 1% by weight of a cationic polymer; and from 0.03% to 5%, preferably from 0.10% to 1% by weight of a cationic polymer or copolymer comprising at least one monomer unit which is cationic or carries at least one positive charge or carries a dipole moment greater than 3.5; and (d) from 5% to 70%, preferably from 10% to 30% by weight of nonionic surfactant.

24 Claims, No Drawings

LIQUID DETERGENT COMPOSITIONS

FIELD OF INVENTION

The present invention relates to isotropic aqueous liquid detergent compositions. It also relates to methods of using such compositions for the cleaning of substrates.

BACKGROUND OF INVENTION

In liquid detergent compositions for the washing of textile fabrics, cationic polymer is sometimes included for reasons such as dye-transfer inhibition. Preferred compositions that give good dye-transfer inhibition results comprise as surfactant only nonionic surfactant(s) or are rich in nonionic surfactant(s). However, when the composition is an isotropic aqueous liquid composition and practical amounts of polymer and/or salts are included, then incompatibility between the nonionic surfactants and/or salts can lead to cloudiness or even physical instability.

We have now found that partially replacing the nonionic surfactant with anionic surfactant(s) solves the problem of incompatibility with the cationic polymer. Moreover we have found that when the anionic surfactant is partially or totally a soap, then the incompatibility of the composition with the salts is further significantly reduced. A further advantage of using soap in isotropic formulations is improved foam control, since the compatibility of isotropic formulations with silicon antifoam is often a problem.

SUMMARY OF INVENTION

Accordingly, in a first aspect, the present invention provides an isotropic aqueous liquid detergent composition comprising:

(a) from 0% to 6%, preferably from 1% to 4% by weight of synthetic anionic surfactant;

(b) from 5% to 25%, preferably from 10% to 20% by weight of soap;

(c) from 0.03% to 5%, preferably from 0.10% to 1% by weight of a cationic polymer or copolymer comprising at least one monomer unit which is cationic or carries at least one positive charge or carries a dipole moment greater than 3.5; and (d) from 5% to 70%, preferably from 10% to 30% by weight of nonionic surfactant.

DETAILED DESCRIPTION OF THE INVENTION

The Liquid Detergent Composition

Liquid detergent compositions generally can be considered either to be isotropic or structured. The compositions of the invention are isotropic, i.e. they are transparent unless an opacifier has been added.

The liquid composition may be formulated as a concentrated cleaning liquid for direct application to a substrate, or for application to a substrate following dilution, such as dilution before or during use of the liquid composition by the consumer or in washing apparatus.

Whilst the composition and method according to the present invention may be used for cleaning any suitable substrate, the preferred substrate is a laundry fabric. Cleaning may be carried out by simply leaving the substrate in contact for a sufficient period of time with a medium constituted by or prepared from the liquid cleaning composition. Preferably, however, the cleaning medium on or containing the substrate is agitated.

Compositions according to the present invention preferably have a viscosity of no more than 1,500 mPa.s, more preferably no more than 1,000 mPa.s, still more preferably, no more than 500 mPa.s.

Isotropic liquid cleaning compositions are defined for the present purpose as liquid detergent compositions wherein the surfactants do not form liquid crystalline phases, like multi-lamellar droplets of surfactant material. Isotropic liquids are generally not birefringent under static conditions but may be birefringent under flow. In practical terms, instability in the isotropic nature of a composition is determined when it becomes hazy or separates into two or more different layers.

Water

Preferably the amount of water in the liquid detergent composition is from 5 to 95%, more preferred from 25 to 75%, most preferred from 30 to 50%. Especially preferred less than 45% by weight.

Surfactant

The isotropic compositions according to the present invention preferably comprise from 1 to 90%, more preferably from 10 to 70% by weight of a synthetic anionic, nonionic, cationic, zwitterionic active detergent material or mixture thereof. Most preferably, the compositions comprise 12 to 60% of surfactant, more preferably 15 to 40%. However, the amount of synthetic anionic surfactant is from 0% to 6%, preferably from 1% to 4% by weight of the composition. The invention is suited to compositions having higher levels of soap plus synthetic surfactant, e.g. above 30% by weight of the composition, although it can also be embodied in compositions with lower levels of these ingredients.

Non-limiting examples of other surfactants useful herein typically at levels from about 0% to about 6%, by weight, include the conventional C11–C18 alkylbenzene sulphonates ("LAS"), the C10–C18 secondary (2,3) alkyl sulphates of the formula $CH3(CH2)_x(CHOS03\text{-}M+)CH3$ and $CH3(CH2)_y(CHOS03\text{-}M+)CH2CH3$ where x and (y+1) are integers of at least about 7, preferably at least about 9, and M is a water-solubilising cation, especially sodium, unsaturated sulphates such as oleyl sulphate, C10–C18 alkyl alkoxy carboxylates (especially the EO 1–7 ethoxycarboxylates), the C10–C18 glycerol ethers, the C10–C18alkyl polyglycosides and their corresponding sulphated polyglycosides, and C12–C18 alpha-sulphonated fatty acid esters. If desired, the conventional nonionic and amphoteric surfactants such as the C12–C18 alkyl ethoxylates ("AE") including the so-called narrow peaked alkyl ethoxylates and C6–C12 alkyl phenol alkoxylates (especially ethoxylates and mixed ethoxy/propoxy), C12–C18 betaines and sulphobetaines ("sultaines"), C10–C18 amine oxides, and the like, can also be included in the overall compositions. The C10–C18 N-alkyl polyhydroxy fatty acid amides can also be used. Typical examples include the C12–C18 N-methylglucamides. See WO 9,206,154. Other sugar-derived surfactants include the N-alkoxy polyhydroxy fatty acid amides, such as C10–C18 N-(3-methoxypropyl) glucamide. C10–C20 conventional soaps may also be used. If high sudsing is desired, the branched-chain C10–C16 soaps may be used.

Mixtures of anionic and nonionic surfactants are especially useful. Other conventional useful surfactants are listed in standard texts.

Other anionic surfactants useful for detersive purposes can also be included in the isotropic compositions hereof. These can include salts (including, for example, sodium potassium, ammonium, and substituted ammonium salts such a mono-, di- and triethanolamine salts) of soap, C9–C20 linear alkylbenzenesulphonates, C8–C22 primary or secondary alkanesulphonates, C8–C24 olefinsulphonates, sulphonated polycarboxylic acids, alkyl glycerol sulphonates, fatty acyl glycerol sulphonates, fatty oleyl glycerol sulphates, alkyl phenol ethylene oxide ether sulphates, paraffin sulphonates, alkyl phosphates, isothionates such as the acyl isothionates, N-acyl taurates, fatty acid amides of methyl tauride, alkyl succinamates and sulphosuccinates, monoesters of sulphosuccinate (especially saturated and unsaturated C12–C18 monoesters) diesters of sulphosuccinate (especially saturated and unsaturated C6–C14 diesters), N-acyl sarcosinates, sulphates of alkylpolysaccharides such as the sulphates of alkylpolyglucoside, branched primary alkyl sulphates, alkyl polyethoxy carboxylates such as those of the formula $RO(CH2CH20)_kCH2COO-M+$wherein R is a C8–C22 alkyl, k is an integer from 0 to 10, and M is a soluble salt-forming cation, and fatty acids esterified with isethionic acid and neutralised with sodium hydroxide. Further examples are given in Surface Active Agents and Detergents (Vol. I and II by Schwartz, Perry and Berch).

Alkyl sulphate surfactants, either primary or secondary, are a type of anionic surfactant of importance for use herein. Alkyl sulphates have the general formula ROS03M wherein R preferably is a C10–C24 hydrocarbyl, preferably an alkyl straight or branched chain or hydroxyalkyl having a C10–C20 alkyl component, more preferably a C12–C18 alkyl or hydroxyalkyl, and M is hydrogen or a water soluble cation, e.g., an alkali metal cation (e.g., sodium potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like.

Typically, alkyl chains of C12–C16 are preferred for lower wash temperatures (e.g., below about 50° C. and C16–C18 alkyl chains are preferred for higher wash temperatures (e.g., about 50° C.).

Alkyl alkoxylated sulphate surfactants are another category of preferred anionic surfactant. These surfactants; are water soluble salts or acids typically of the formula RO(A) mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is hydrogen or a water soluble cation which can be, for example, a metal cation (e.g., sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are C12–C18 alkyl polyethoxylate (1.0) sulphate, C12–C18 alkyl polyethoxylate (2.25) sulphate, C12–C18 alkyl polyethoxylate (3.0) sulphate, and C12–C18 alkyl polyethoxylate (4.0) sulphate wherein M is conveniently selected from sodium and potassium.

The isotropic compositions of the present invention preferably comprise at least about 5%, preferably at least 10%, more preferably at least 12% and less than 70%, more preferably less than 60% by weight, of a nonionic surfactant.

Preferred nonionic surfactants such as C10–C18 alkyl ethoxylates ("AE") including the so-called narrow peaked alkyl ethoxylates and C6–C12 alkyl phenol alkoxylates (especially ethoxylates and mixed ethoxy/propoxy), block alkylene oxide condensate of C6 to C12 alkyl phenols, alkylene oxide condensates of C8–C22 alkanols and ethylene oxide/propylene oxide block polymers (Pluronic™-BASF Corp.), as well as semi polar nonionics (e.g., amine oxides and phosphine oxides) can be used in the present isotropic compositions. An extensive disclosure of these types of surfactants is found in U.S. Pat. No. 3,929,678.

Alkylpolysaccharides such as disclosed in U.S. Pat. No. 4,565,647 are also preferred nonionic surfactants in the isotropic compositions of the invention.

Further preferred nonionic surfactants are the polyhydroxy fatty acid amides.

A particularly desirable surfactant of this type for use in the isotropic compositions herein is alkyl-N-methyl glucamide.

Other sugar-derived surfactants include the N-alkoxy polyhydroxy fatty acid amides, such as C10–C18 N-(3-methoxypropyl) glucamide. The N-propyl through N-hexyl C12–C18 glucamides can be used for low sudsing. C10–C20 conventional soaps may also be used. If high sudsing is desired, the branched-chain C10–C16 soaps may be used.

Soaps

Compositions of the present invention include at least one soap, i.e. a salt of fatty acids. Examples of fatty acids suitable for use of the present invention include pure or hardened fatty acids derived from palmitoleic, safflower, sunflower, soybean, oleic, linoleic, linolenic, ricinoleic, rapeseed oil or mixtures thereof. Mixtures of saturated and unsaturated fatty acids can also be used herein, but saturated soaps are preferred.

It will be recognised that the fatty acid will be present in the liquid detergent isotropic composition primarily in the form of a soap. Suitable cations include, sodium, potassium, ammonium, monoethanol ammonium, diethanol ammonium, triethanol ammonium, tetraalkyl ammonium, e.g., tetra methyl ammonium up to tetradecyl ammonium etc. cations.

The amount of soap will vary depending on the particular characteristics desired in the final detergent isotropic composition but range from 5% to 25%, preferably from 10% to 20% by weight of the composition.

The compositions of the present invention must include one or more cationic polymers, materials e.g. effective for inhibiting the transfer of dyes from one fabric to another during the cleaning process. Typically, they are polymers or copolymers derived from monomers having or forming cyclic or non-cyclic groups containing a quaternary nitrogen atom, e.g. derived from vinyl pyrrolidone and/or vinylimidazole monomers. Such polymers include polyvinyl pyrrolidone polymers, polyamine N-oxide polymers, copolymers of N-vinylpyrrolidone and N-vinylimidazole and mixtures thereof. The amount of cationic polymer is from about 0.03% to about 5% by weight of the composition, preferably from about 0.05% to about 3%, and more preferably from about 0.10% to about 1% by weight of the total composition. The number average molecular weight of such polymers is typically from 3,000 to 50,000, preferably from 5,000 to 30,000.

The Polymer

The polymer comprises a polymer or copolymer comprising at least one monomer which is cationic or carries at least one positive charge or carries a dipole moment greater than 3.5.

To determine the dipole moment, one can use the AM1 method of the MOPAC program, e.g. in v.6.0. This is outlined in Dewar, M. J. S., J. Mol. Struct., 100, 41 (1983). In October 2001, a copy of the program was downloadable from http://qcpe.chem.indiana.edu/.

Preferred cationic polymers and copolymers comprising at least one preferred cationic monomer unit either of formula —($CR^1R^2$—$CR^3Q$)— wherein each of $R^1$–$R^3$ is independently selected from hydrogen, $C_{1-4}$ alkyl, optionally substituted phenyl, optionally substituted benzyl, carbocyclic and heterocyclic groups and Q is selected from groups of formula —$(CH_2)_x$—$(CO)_y$—$R^4$ where x is 0 to 6 and y is 0 or 1, $R^4$ being selected from —$O(CH_2)_zN^+(R^5)_3X^-$, —$OCO(CH_2)_zN^+(R^5)_3X^-$, —$NHCO(CH_2)_zN^+(R^5)_3X^-$, —$(CH_2)_zN^+(R^5)^3X^-$, nitrogen heterocyclic quaternary ammonium, nitrogen heterocyclic N-oxide, aromatic N-heterocyclic quaternary ammonium, aromatic N-heterocyclic N-oxide; where z is from 0 to 6, $X^-$ is a water soluble cation such as an alkali metal ion and $R^5$ is selected from hydrogen, $C_1$–$C_8$ alkyl and $C_2$–$C_8$ hydroxyalkyl; or else derived from monomers of formula:

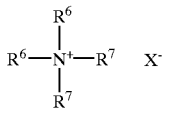

wherein each $R^6$ is independently an olefin comprising unit which is capable of propagating polymerization in addition to forming a cyclic residue with an adjacent $R^6$ unit; $R^7$ is $C_1$–$C_{12}$ linear or branched alkyl, benzyl, substituted benzyl, as hereinbefore defined.

Preferred monomer units carrying at least one positive charge contain heterocyclic N—$R^1$–$R^8$ moieties where the nitrogen atom is quaternized and $R^8$ is independently selected from carboxylate and sulphonate.

Preferred monomer units carrying a dipole moment above 3.5 are cyclic moieties containing one or more heteroatoms such as nitrogen and having one or more unsaturated bonds either within the ring or attached to the ring, e.g. pyrrolidone, imidazole and mixtures thereof.

Preferred co-monomers for copolymerization with the preferred cationic or dipole carrying monomer units defied above are those of formula —($CR^1R^2$—$CR^3R^8$) wherein $R^1$–$R^3$ are as hereinbefore defined and $R^8$ is independently selected from hydroxy, groups as hereinbefore defined for any of $R^1$–$R^3$ and groups of formula —$(CH_2)_x$—$(CO)_y$—$R^9$ where x and y are as hereinbefore defined and $R^9$ is selected from hydrogen, hydroxyl, halogen, nitrilo, —$OR^3$, —$O(CH_2)_xN(R^5)_2$, —$OCO(CH_2)_xN(R^5)_2$, —$NHCO(CH_2)_xN(R^5)_2$ —$(CH_2)_xN(R^5)_2$, carbocyclic, heterocyclic, —NHCHO, wherein z and $R^5$ are as hereinbefore defined. These polymers are commercially available or may be prepared as described in WO-A-01/53600.

Especially preferred are cationic dye fixative polymers and copolymers, examples of which include the following commercially available materials: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy. A preferred dye fixing agent for use in the compositions of the present invention is CARTAFIX CB® ex Clariant. Other cationic dye fixing agents are described in "Aftertreatments for Improving the Fastness of Dyes on Textile Fibres", Christopher C. Cook, *Rev. Prog. Coloration*, Vol. XII.

Especially preferred polymers and copolymers comprising a monomer unit carrying a dipole moment above 3.5 are polyvinylpyrrolidone (PVP) and polyvinylpyrrolidone/polyvinyleimidazole (PVP/PVI) as described in WO-A-97/23591 and WO-A-97/23592.

Also suitable are the zwitterionic polymers disclosed in U.S. Pat. No. 6,093,776 and U.S. Pat. No. 6,271,386.

Solvents

Isotropic liquid detergent compositions contain water and optionally, other solvents as carriers. Low molecular weight primary or secondary alcohols exemplified by methanol, ethanol, propanol, and isopropanol are suitable. Monohydric alcohols are preferred for solubilising surfactant. The compositions may contain from 5% to 90%, typically 10% to 50% of such carriers.

Clarity

The clarity of the isotropic compositions according to the present invention does not preclude the isotropic composition being coloured, e.g. by addition of a dye, provided that it does not detract substantially from clarity. Moreover, an opacifier could be included to reduce clarity if required to appeal to the consumer. In that case the definition of clarity applied to the isotropic composition according to any aspect of the invention will apply to the base (equivalent) isotropic composition without the opacifier.

Detergency Builders

Suitable water soluble inorganic detergency builders, which are optional components of compositions according to the present invention, are electrolytes, i.e. are not water soluble.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorous-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites, although there are restrictions with respect to the amount and volume fraction of solid particles which can be added while retaining substantial clarity.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1 302 543.

Examples of organic detergency builders, when present, include the alkaline metal, ammonium and substituted ammonium polyacetates, carboxylates, polycarboxylates, polyacetyl carboxylates, carboxymethyloxysuccinates, carboxymethyloxymalonates, ethylene diamine-N,N-disuccinic acid salts, polyepoxysuccinates, oxydiacetates, triethylene tetramine hexa-acetic acid salts, N-alkyl imino diacetates or dipropionates, alpha sulpho-fatty acid salts, dipicolinic acid salts, oxidised polysaccharides, polyhydroxysulphonates and mixtures thereof.

Specific examples include sodium, potassium, lithium, ammonium and substituted ammonium salts of ethylenediamino-tetraacetic acid, nitrilo-triacetic acid, oxydisuccinic acid, melitic acid, benzene polycarboxylic acids and citric acid, tartrate mono succinate and tartrate di succinate.

In the context of organic builders, it is also desirable to incorporate polymers which are only partly dissolved in the aqueous continuous phase. This allows a viscosity reduction (owing to the polymer which is dissolved whilst incorporating a sufficiently high amount to achieve a secondary benefit, especially building, because the part which is not dissolved does not bring about the instability that would occur if substantially all were dissolved). As for inorganic builders, the same restrictions apply with respect to the amount and volume fraction of non-dissolved polymer phase which can be added while retaining substantial clarity.

The incorporation of the soluble polymer permits formulation with improved stability at the same viscosity (relative to the structured composition without the soluble polymer) or lower viscosity with the same stability. The soluble polymer can also reduce viscosity drift, even when it also brings about a viscosity reduction. Here, improved stability and lower viscosity mean over and above any such effects brought about by the deflocculating polymer.

The soluble polymer must have an average molecular weight of at least 1,000 but a minimum average molecular weight of 2,000 is preferred.

The use of partly soluble and the use of soluble polymers as referred to above in detergent compositions is described in our European patent specifications EP-A-301 882 and EP-A-301 883.

Hydrotropes

It is also possible to incorporate minor amounts of hydrotropes such as lower alcohols (e.g. ethanol) or alkanolamines (e.g. triethanolamine), in order to ensure integrity of the lamellar dispersion we prefer that the structured compositions of the present invention are substantially free from hydrotropes. By hydrotrope is meant any water soluble agent which tends to enhance the solubility of surfactants in aqueous solution.

Other Optional Ingredients

The compositions herein can further comprise a variety of optional ingredients. A wide variety of other ingredients useful in detergent compositions can be included in the compositions herein, including other active ingredients, processing aids, dyes or pigments. If high sudsing is desired, suds boosters such as the C10–C16 alkanolamides can be incorporated into the compositions, typically at 1%–10% levels. The C10–C 14 monoethanol and diethanol amides illustrate a typical class of such suds boosters. Use of such suds boosters with high sudsing; adjunct surfactants such as the amine oxides, betaines and sultaines noted above is also advantageous. If desired, soluble magnesium salts such as MgCl2, MgS04, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

Chelating Agents

The detergent compositions herein may also optionally contain one or more iron, copper and/or manganese chelating agents. Such chelating agents can be selected from the group consisting of amino carboxylates, amino phosphonates, polyfanctionally-substituted aromatic chelating agents and mixtures therein, all as hereinafter defined.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-Redeposition Agents

The compositions of the present invention can also optionally contain water-soluble ethoxylated amines having clay soil removal and antiredeposition properties.

Liquid detergent compositions typically contain about 0.01% to about 5% of these agents.

One preferred soil release and anti-redeposition agent is ethoxylated tetraethylenepentamine. Exemplary ethoxylated amines are further described in U.S. Pat. No. 4,597,898, Another type of preferred antiredeposition agent includes the carboxy methyl cellulose (CMC) materials. These materials are well known in the art.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, cournarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and infront-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Although the soap in the present formulation also acts as a suds suppressor, the detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic C18–C40 ketones (e.g., stearone), etc.

The preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779.

For any detergent compositions to be used in automatic laundry washing machines, suds should not form to the extent that they overflow the washing machine.

Suds suppressors, when utilized, are preferably present in a "suds suppressing amount".

By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0.1% to about 5% of suds suppressor.

Enzymes

"Detersive enzyme", as used herein, means any enzyme having a cleaning, stain removing or otherwise beneficial effect in a laundry application. Enzymes are included in the present detergent compositions for a variety of purposes, including removal of protein-based, saccharide-based, or triglyceride-based stains, for the prevention of refugee dye transfer, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.0001% to 10%, preferably from 0.001% to 5%, more preferably 0.005%–1% by weight of a commercial enzyme preparation.

Other than in the examples, or where otherwise indicated, all numbers expressing quantities of ingredients or reaction conditions used herein are to be understood as modified in all instances by the term "about". Similarly, all percentages are weight/weight percentages of the carbon dioxide unless otherwise indicated. Where the term "comprising" is used in the specification or claims, it is not intended to exclude any terms, steps or features not specifically recited.

In typical washing compositions the level of the organic substance is such that the in-use level is from 0.05 $\mu$M to 50 mM, with preferred in-use levels for domestic laundry operations falling in the range 1 to 100 $\mu$M. Higher levels may be desired and applied in industrial bleaching processes, such as textile and paper pulp bleaching.

Preferably, the aqueous medium has a pH in the range from pH 6 to 13, more preferably from pH 6 to 11, and most preferably from 7 to 10.

The invention will now be further illustrated by way of the following non-limiting examples:

EXAMPLES

| Raw material as 100% | Example 1 | Control |
|---|---|---|
| Oleic acid | 6.90 | — |
| Coconut fatty acid | 4.60 | — |
| LAS acid | — | 11.24 |
| NI $C_{12}$–$C_{15}$<7E0> | 18.00 | 18.00 |
| NaOH | 1.05 | 1.01 |
| Sodium Citrate 2 aq | from 1 to 10% | |
| Sodium tetraborate pentahydrate | 3.00 | 3.00 |
| Propylene Glycol | 5.00 | 5.00 |
| Antioxidant BHT | 0.04 | 0.00 |
| Tinopal UNPA-GX | 0.24 | 0.24 |
| Alcosperse 725 | 0.36 | 0.36 |
| PVP | 0.3 | 0.3 |
| Preservative | Up to 100% | 0.00036 |
| Water | | |
| Neutralised for | 60 | 73 |
| Final pH | 8 | 8 |

| Na Citrate 2 aq | Appearance after 1 day at Room Temperature | |
|---|---|---|
| (wt %) | Example 1 | Control |
| 0 | Clear | Clear |
| 1 | Clear | Clear |
| 2 | Clear | Hazy |
| 3 | Clear | Unstable |
| 4 | Clear | Unstable |
| 5 | Clear | Unstable |
| 6 | Clear | Unstable |
| 7 | Clear | Unstable |
| 8 | Clear | Unstable |
| 9 | Clear | Unstable |
| 10 | Clear | Unstable |

It can be seen that the composition of Example 1 was tolerant to electrolyte over the whole range of 0–10% added citrate whereas the Control became hazy at 2% and then unstable (as evidenced by phase separation) at 3% and above.

What is claimed is:

1. An isotropic aqueous liquid detergent composition comprising:

(a) from 0% to 4% by weight of synthetic anionic surfactant;

(b) from 5% to 25% by weight of soap;

(c) from 0.03% to 5% by weight of a cationic polymer is selected from the polymers and copolymers comprising one or more of monomers units derived from vinyl pyrrolidone, vinylimidzole, and mixtures thereof; and (d) from 5% to 70% by weight of nonionic surfactant.

2. A composition according to claim 1, wherein the synthetic anionic surfactant is a non-ethoxylated anionic surfactant.

3. A composition according to claim 1, wherein the synthetic anionic surfactant is selected from alkylbenzene sulphonates, primary alkyl sulphates, secondary alkyl sulphates and mixtures thereof.

4. A composition according to claim 1, wherein the soap is selected from one or more alkali metal saturated soaps.

5. A composition according to claim 1, wherein the soap is selected from one or more alkali metal unsaturated soaps.

6. A composition according to claim 1, wherein the soap is selected from a mixture of one or more alkali metal saturated soap(s) and one or more alkali metal saturated soap(s).

7. A composition according to claim 1, wherein the cationic polymer has a number average molecular weight of from 3,000 to 50,000.

8. A composition according to claim 1, wherein the nonionic surfactant is an alkyl ethoxylate.

9. A composition according to claim 1 wherein the composition comprises from 10 to 20% by weight of soap.

10. A composition according to claim 1 wherein the composition comprises from 0.10% to 1% by weight of the cationic polymer.

11. A composition according to claim 1 wherein the composition comprises from 10 to 30% by weight of nonionic surfactant.

12. A composition according to claim 4 wherein the soap contains from 8 to 22 carbon atoms.

13. A composition according to claim 4 wherein the soap contains from 10 to 20 carbon atoms.

14. A composition according to claim 5 wherein the soap contains from 12 to 22 carbon atoms.

15. A composition according to claim 5 wherein the soap contains from 14 to 20 carbon atoms.

16. A composition according to claim 7 wherein the polymer has a number average molecular weight of from 5,000 to 30,000.

17. An isotropic aqueous liquid detergent composition comprising:

(a) from 0% to 6% by weight of synthetic anionic surfactant;

(b) from 5% to 25% by weight of soap;

(c) from 0.03% to 5% by weight of a cationic polymer is selected from the polymers and copolymers comprising one or more of monomers units derived from vinyl pyrrolidone, vinylimidzole, and mixtures thereof; and (d) at least 12% by weight of nonionic surfactant.

18. A composition according to claim 17, wherein the synthetic anionic surfactant is a non-ethoxylated anionic surfactant.

19. A composition according to claim 17, wherein the synthetic anionic surfactant is selected from alkylbenzene sulphonates, primary alkyl sulphates, secondary alkyl sulphates and mixtures thereof.

20. A composition according to claim 17, wherein the soap is selected from one or more alkali metal saturated soaps.

21. A composition according to claim 17, wherein the soap is selected from one or more alkali metal unsaturated soaps.

22. A composition according to claim 17, wherein the soap is selected from a mixture of one or more alkali metal saturated soap(s) and one or more alkali metal saturated soap(s).

23. A composition according to claim 17, wherein the cationic polymer has a number average molecular weight of from 3,000 to 50,000.

24. A composition according to claim 17 wherein the nonionic surfactant is an alkyl ethoxylate.

* * * * *